US005373616A

United States Patent [19]

Biersdorf et al.

[11] Patent Number: 5,373,616

[45] Date of Patent: Dec. 20, 1994

[54] APPARATUS FOR APPLYING HANGRIPS TO ARTICLES SUCH AS SPORTS EQUIPMENT AND THE LIKE

[75] Inventors: Jack S. Biersdorf, Wayzata; Lee A. Biersdorf, Minneapolis, both of Minn.

[73] Assignee: BOA, Inc., Wayzata, Minn.

[21] Appl. No.: 40,871

[22] Filed: Mar. 31, 1993

[51] Int. Cl.[5] ..... B23P 19/02

[52] U.S. Cl. ..... 29/235; 29/281.5; 29/423; 29/450; 206/69; 273/81 R

[58] Field of Search ..... 29/235, 423, 450, 281.5; 206/69, 315.1; 273/81 R, 81.5, 165

[56] References Cited

U.S. PATENT DOCUMENTS

| | | | |
|---|---|---|---|
| D. 240,367 | 6/1976 | Cope | D21/2 |
| 1,165,484 | 12/1915 | Zimmerman . | |
| 2,038,840 | 4/1936 | Hall | 29/33.2 |
| 2,046,191 | 6/1936 | Smith | 29/33.2 |
| 2,984,486 | 5/1961 | Jones | 273/72 |
| 3,515,798 | 6/1970 | Sievert | 174/135 |
| 3,606,325 | 9/1971 | Lamkin et al. | 273/81.5 |
| 3,606,326 | 9/1971 | Sparks et al. | 273/81 R |
| 3,606,327 | 9/1971 | Gorman | 273/81 A |
| 3,614,100 | 10/1971 | Spitz | 273/75 |
| 3,808,352 | 4/1974 | Johnson | 174/73 R |
| 3,972,528 | 8/1976 | McCracken et al. | 273/72 A |
| 4,016,640 | 4/1977 | Briggs | 29/450 |
| 4,134,198 | 1/1979 | Briggs | 29/450 |
| 4,185,375 | 1/1980 | Brown | 29/450 |
| 4,466,166 | 8/1984 | Hogarth | 29/235 |
| 4,506,430 | 3/1985 | Guzay, Jr. | 29/450 |
| 4,585,607 | 4/1986 | Krackler et al. | 264/229 |
| 4,653,170 | 3/1987 | Kelson | 29/450 |
| 4,660,832 | 4/1987 | Shomo | 273/73 J |
| 4,685,189 | 8/1987 | Palmqvist et al. | 29/450 |
| 4,871,599 | 10/1989 | Knorr | 29/235 X |
| 4,912,836 | 4/1990 | Avetoom | 29/450 |
| 4,953,862 | 9/1990 | Uke et al. | 273/75 |
| 5,080,942 | 1/1992 | Yau | 428/349 |
| 5,098,752 | 3/1993 | Chang et al. | 428/34.9 |

OTHER PUBLICATIONS

Tacki-Mac ® Grip Brochure; undated.

*Primary Examiner*—Mark Rosenbaum
*Assistant Examiner*—S. Thomas Hughes
*Attorney, Agent, or Firm*—Philip G. Alden

[57] ABSTRACT

A method and apparatus for installing an elastomeric handgrip on an article. The handgrip is initially stretched over a hollow core consisting of one or more sections that can be removed from within the handgrip using slight tension. The proximal end of the assembly is placed over the article with the distal end of the handgrip aligned with the desired position, in some cases a positioning member being used to ensure proper alignment. The core is removed by tensioning the distal end, permitting the tubular handgrip to contract progressively starting from the distal end. In one embodiment, the core is a thin flat strip wound spirally and connected along abutting edges to form a helical tear line. The free end of the strip passes longitudinally through the bore from the distal to proximal end. Tension on the free end breaks the leading edge of the tear line, causing the strip to unwind and sequentially collapse each looped segment due to the force exerted by the handgrip. In another embodiment, the core is formed from sections mating along longitudinal seams. Longitudinal strips of tape material are disposed between the handgrip and core, with their free ends extending through the bore from the distal to proximal end. The strips have a lower friction surface contacting the core and a higher friction surface contacting the handgrip. Tension on the free ends slidably withdraws the core from the handgrip, which contracts onto the article.

28 Claims, 10 Drawing Sheets

APPARATUS FOR APPLYING HANGRIPS TO ARTICLES SUCH AS SPORTS EQUIPMENT AND THE LIKE

BACKGROUND OF THE INVENTION

This invention relates generally to a method and apparatus for applying an elastomeric handgrip to the handle of sporting goods such as a baseball or softball bat, tennis racquet, golf club, as well as to tools, implements, equipment, or other articles having an elongated handle segment, without the use of an installation fixture.

Many different types of handgrips are known for sporting goods, tools, implements, equipment, and other hand-held articles to increase the friction between the user's hand and the article, to provide protection or cushioning, and to achieve a particular mechanical advantage when using the article.

Cloth, leather, rubber, and plastic handgrips are adhered or otherwise applied to these types of articles, with installation of the handgrip being accomplished by a variety of methods: the handgrip may be wrapped around the handle segment of the article; the article may be dipped in or coated with a liquid compound that dries or congeals; a hollow tubular section of handgrip may be distended and the handle section of the article inserted longitudinally into the handgrip using an installation fixture; a handgrip member may be manufactured as an integral unit and mounted on the article; the handgrip may be molded or formed unitary with the article itself.

The subject matter of the present invention relates more specifically to applying or affixing a handgrip to an article subsequent to the initial manufacturing process, such as when replacing worn or inferior grips with new or preferred grips, adding a secondary grip with different physical characteristics in order to enhance the cushioning or gripping properties of the original, or mounting a grip on an article originally manufactured without any handgrip.

Elastomeric handgrips fabricated from rubber or plastic with either a smooth or serrated gripping surface are currently the preferred choice for baseball and softball bats, tennis and racquetball racquets, golf clubs, and other sporting goods. Using a baseball or softball bat as a representative example, two particular methods are most frequently utilized commercially for applying an elastomeric handgrip to the handle segment of such an article.

In the first method, a tubular grip having a closed end is placed within a vacuum chamber similarly having an open end, and the open end of the tubular grip is sealed around the open end of the chamber. Negative pressure is drawn between the chamber and the tubular grip, thus causing the tubular grip to expand or distend. The handle of the bat or other article is then inserted into the open end of the tubular grip, and the pressure within the chamber is equalized with the normal air pressure. The tubular grip contracts over the handle segment of the article, and any excess portion of the grip material is then cut away from the handle segment using a suitable cutting instrument. Such a method is disclosed in U.S. Pat. Nos. 4,016,640 and 4,134,198 to Briggs, and the vacuum system and grips are currently marketed by 'totes' Incorporated of Loveland, Ohio.

The type of grips which may be applied using this process are limited to thin rubber materials having a relatively low elastic modulus due to the weak negative pressure that may be drawn using an electric motor driven vacuum pump. It is also necessary to cut away the excess material from the open end, and often the enclosed end of the tubular grip, which frequently results in an unfinished and aesthetically unsuitable appearance. Besides stocking the line of handgrips themselves, it is also necessary for a typical sporting goods store or pro shop to keep the equipment accessible in a predetermined area, maintain the motor and vacuum system in a safe and proper working condition, and staff the facility with trained operators.

In the second method, a tubular grip having two open ends is placed on an installation fixture, usually having a plurality of longitudinal tines that may flex radially outward and separate from one another. The length of the fixture is sufficient that if the tubular grip surrounds and constrains the tines at one end, the opposing ends of the tines may be manually separated so that the end of the bat or article may be received within or between those tines. The article is then forced further into the fixture, with the pressure exerted radially outward by the article on the tines being used to stretch and expand the tubular grip. Once the tubular grip is positioned circumscribing the desired portion of the handle segment, the fixture is removed from between the article and the tubular grip. Representative examples of this method and the associated installation fixtures are disclosed in U.S. Pat. Nos. 2, 038,840 to Hall and 4,466,166 to Hogarth.

Such a system permits thicker grips with a higher elastic modulus to be applied to such articles as softball or baseball bats when using a fixture supported by a tripod, however the force required must usually be exerted using a person's body weight or a levering device. Such an installation fixture, tripod, lever device, and grips are currently marketed by Tacki-mac® Grips, Inc. of Canoga Park, Calif. for use with baseball and softball bats and racquetball racquets. Removing the fixture may also present problems, such as interfering with the proper placement of the handgrip on the desired portion of the handle segment, or damaging the grip material or surface of the article.

A variation on this method utilizes a grip that is initially turned inside-out on one or more sleeves and lubricated, or folded repeatedly in discrete segments, as disclosed in U.S. Pat. Nos. 4,506,430 to Guzay; 4,685,189 to Palmqvist; and 4,912,836 to Avetoom.

These systems have proven workable for some applications involving relatively thin articles with uniform non-tapered cross-sections, such as golf club handles and high tension cables, but are not deemed suitable for larger applications such as baseball and softball bats, and would only be suitable for tennis or racquetball racquets and the like if the material is extremely thin. Removal of the sleeve can require more force or pull than can be accomplished manually, and the process can be time consuming. In addition, removal of the sleeve is problematical, particularly where the handle segment has a knob-shaped end, or where the handgrip is preferably or necessarily installed from the proximal as opposed to the distal end of a tapered article.

U.S. Pat. No. 4,185,375 to Brown discloses a method of applying a tubular elastomeric handgrip to articles such as sporting goods in which the handgrip is rolled into a spiral toroid and disposed on a hollow rigid cylindrical core from which the handgrip may be unrolled onto the handle segment. A plurality of handgrips may be positioned sequentially on the core. The handgrips are rolled using a forming mandrel having a thin cylindrical section joined to a thicker cylindrical section having a diameter equal to the core by a flared intermediate section which stretches the rolled handgrip to the appropriate size.

This system is only practical for use with handgrips having a very thin thickness or a very short length, since rolling the handgrip into a spiral toroid increases the compression ratio and force needed to expand the diameter of the toroid by many times. This process can also be destructive to the handgrip material itself, since the rolling process causes extreme lateral and axial deformation of the material within each spiral loop, and the shelf life of a rolled handgrip is therefore reduced significantly. It is also difficult and expensive to automate the rolling process and maintain uniformity.

BRIEF SUMMARY OF THE INVENTION

It is therefore one object of this invention to design a method and apparatus for applying an elastomeric handgrip having a high elastic modulus to a handle segment of an article without the use of a separate installation fixture.

It is another object of this invention to design the above method and apparatus so that one or more handgrips may be manually applied to an handle segment without the use of an installation fixture, and exerting relatively little or no longitudinal force or pressure on the handgrip or apparatus.

It is a further object of this invention to design the above method and apparatus so as to permit very precise and selective placement of the handgrip on the handle segment.

It is yet another object of this invention to design the above method and apparatus such that it may be utilized with handgrips having either two open ends or one enclosed end, and with articles having either a uniform or tapered cross-section or a knob-shaped end.

Briefly described, the method and apparatus each involve providing the installer with an assembly including an elastomeric tubular handgrip that is initially stretched over a hollow rigid cylindrical core, and which permits the user to apply the handgrip to an article using no other fixtures or equipment. The core defines a bore greater in diameter than the handle segment of the article or any projection that is to be traversed in mounting the handgrip on the handle segment. The core consists of a plurality of mating sections that are joined or contact one another and can be removed from within the tubular handgrip using very slight tension. The proximal end of the core and handgrip assembly are placed longitudinally over the handle segment until the distal end of the handgrip is aligned with its desired position. If the handgrip is of a type having two open ends, proper alignment may be accomplished using a positioning member situated at the distal end of the core and handgrip assembly. The free end of the handle segment will abuttingly contact a surface on the positioning member to ensure alignment of the leading edge of the handgrip with a predetermined position on the handle segment. The core is then removed from the handgrip by tensioning the distal end of the core, permitting the tubular handgrip to contract and contact the handle segment starting at the distal end thereof and progressing toward the proximal end.

In one embodiment, the core comprises a thin flat strip wound into a spiral and sonically welded along the adjacent abutting edges. The free end of the strip passes longitudinally through the bore of the core from the distal end to the proximal end, and tension on the free end of the strip breaks the leading edge of the weld, thereby causing the strip to unwind and sequentially collapse each looped segment due to the force exerted by the handgrip.

In a second embodiment, the core is comprised of tube consisting of a single piece having no longitudinal seams, a single piece having a single longitudinal seam, or a plurality of mating sections contacting or joined to one another along lateral seams and each having one or more longitudinal seams. One or more longitudinal strips of a tape material are disposed between the handgrip material and the core, with the free ends of the tape material extending through the bore from the distal end to the proximal end. The tape material preferably has a lower friction surface contacting the core and a higher friction surface contacting the handgrip. Tension on the free end of the strips causes the core to be slidably withdrawn from the handgrip, and the handgrip contracts into contact with the handle segment.

DESCRIPTION OF THE PREFERRED EMBODIMENTS

The core and sleeve assembly for mounting a handgrip on an article of this invention is shown in FIGS. 1–16 and referenced generally therein by the numeral 10.

The core and sleeve assembly 10 consists of a hollow cylindrical core member 12 and a elastomeric tubular sleeve member 14 that is initially mounted in a stretched, expanded, or distended configuration circumferentially surrounding the core member 12.

Spiral Strip Embodiment

Figure 1:
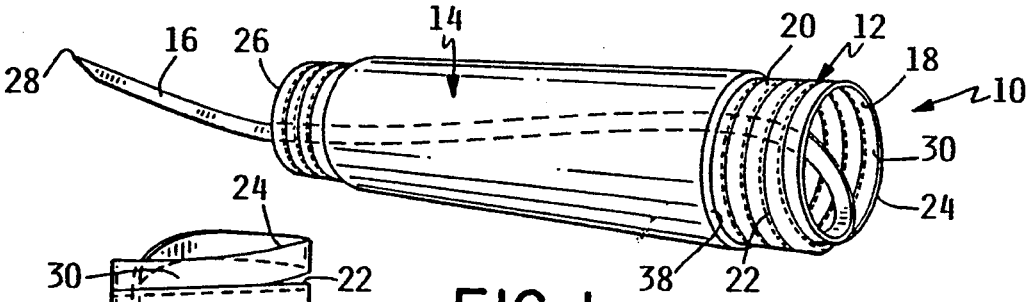
FIG. 1 is a perspective view of the spiral strip embodiment of the core and grip assembly of this invention, with the distal end of the core disposed toward or nearest the viewer.

Referring particularly to FIG. 1, a spiral strip embodiment of the core and sleeve assembly 10 is shown.

The core member 12 is preferably constructed from a single flat strip or web 16 of plastic material, although cardboard or fiberboard may be used in some applications, which is wrapped or wound in a tight spiral or series of abutting loops forming generally coplanar inner and outer cylindrical surfaces 18, 20, respectively. The abutting transverse seams or edges 22 of the spiraled strip 16 are fastened together along substantially the entire length thereof using a conventional fastening technique such as sonic or thermal welding, adhesive bonding, or the like, in order to reinforce the core member 12 such that the core member 12 remains rigid and cylindrical when pressure is exerted radially inward against the outer surface 20 thereof, and to form a scored or separable tear line between each of the adjacent abutting loops of the spiral. The core member 12 may alternately be fabricated from a rigid tube that is spirally grooved with a narrow V-shaped groove to form a helix, with each coil or loop remaining interconnected with the adjacent coils or loops defined by the groove.

The sleeve member 14 may be any suitable elastomeric material such as rubber or plastic having a relaxed circumference and an expanded or stretched circumference. The relaxed circumference is generally less than or approximately equal to the outer circumference of the outer surface 20 of the core member 12, with the sleeve member 14 initially being stretched to the expanded circumference and mounted in circumscribing relation to the outer surface 20 of the core member 12 such that generally uniform radial pressure is exerted by the sleeve member 14 on the core member 12.

Referring particularly to FIG. 1, it may be seen that the core and sleeve assembly 10 has a distal end 24 and a proximal end 26. The free end 28 of the strip 16 is initially disconnected or separated from the endmost coil or loop 30 of the core member 12, and passed longitudinally through the bore or hollow center opening of the core member 12 such that the free end 28 extends outwardly several inches from the proximal end 26 of the core member 12.

Figure 2:
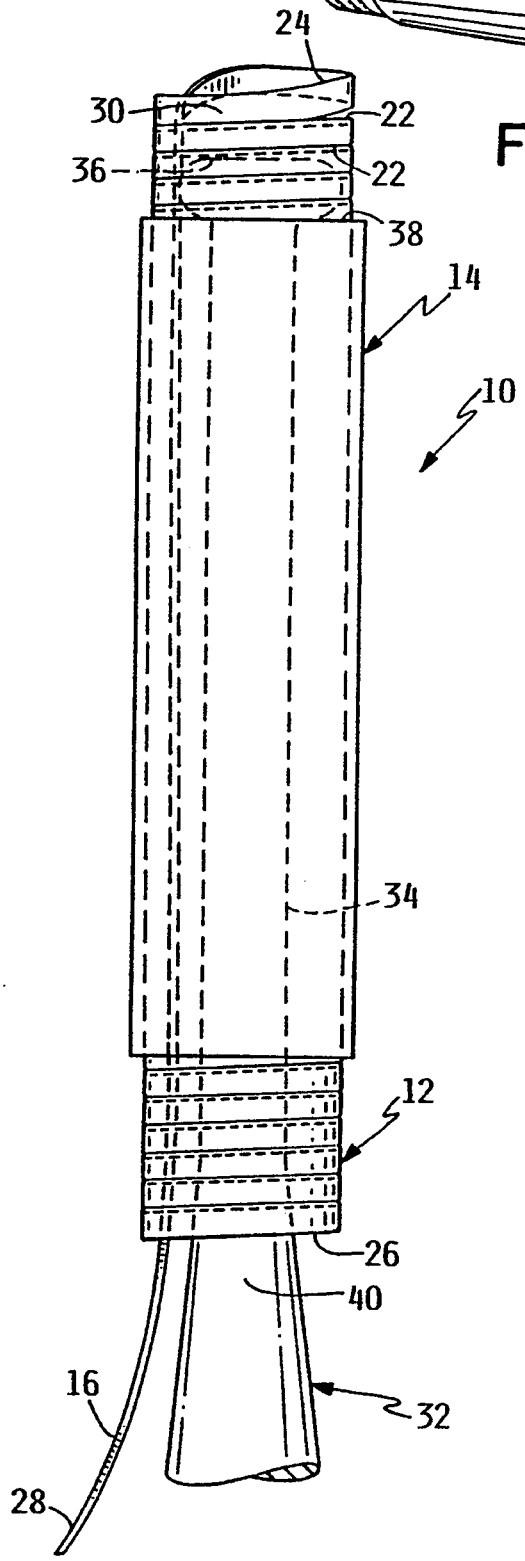
FIG. 2 is a side elevation view of the core and grip assembly of FIG. 1 receiving the handle segment and knob-shaped cap of a baseball bat within the bore of the core.
Figure 3:
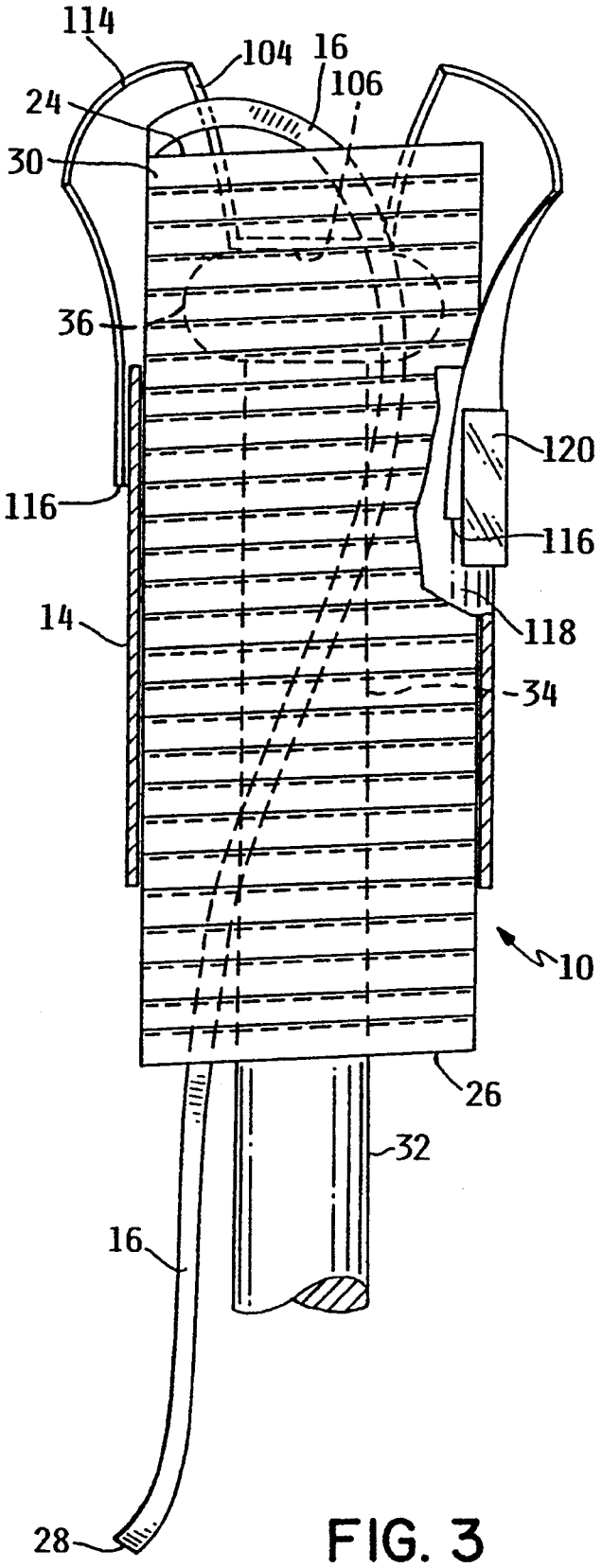
FIG. 3 is side elevation view of the core and grip assembly of the type shown in FIG. 1 with a positioning member disposed at the distal end thereof to align the grip at a predetermined position the handle segment of the baseball bat.

Referring particularly to FIGS. 1–3 and 5–7, it may be seen that in operation an article such as a baseball bat 32 having a generally cylindrical handle segment 34 and a knob-shaped end cap 36 is aligned axially with the core and sleeve assembly 10 such that the knob-shaped end cap 36 or other exposed end of the article adjacent to the handle segment 34 is most closely proximate to the proximal end 26 of the core and sleeve assembly 10. The free end 28 of the strip 16 is moved radially outward as close as practicable to the inner surface 18 of the core member 12, and the handle segment 34 of the bat 32 is slidably inserted longitudinally into and at least partially through the hollow bore of the core member 12 until the leading edge 38 of the sleeve member 14 is radially aligned with and overlapping a selectively predetermined position or reference point on the handle segment 34 as shown in FIG. 2. In the case of an article such as a baseball bat 32, the reference point will generally be the joint between the cylindrical handle segment 34 and the knob-shaped end cap 36, with the distal end 24 of the core member 12 of the core and sleeve assembly 10 extending beyond the knob-shaped end cap 36 as shown particularly in FIG. 2. Referring particularly to FIG. 3, it may be seen that a positioning member 104 may be fixedly connected to the core and sleeve assembly 10 such that the knob-shaped end cap 36 of the baseball bat 32 abuttingly contacts a generally parallel, confronting surface 106 of the positioning member 104 to align the end of the sleeve member 14 at a predetermined position or reference point on the handle segment 34 of the baseball bat 32.

Figure 4:
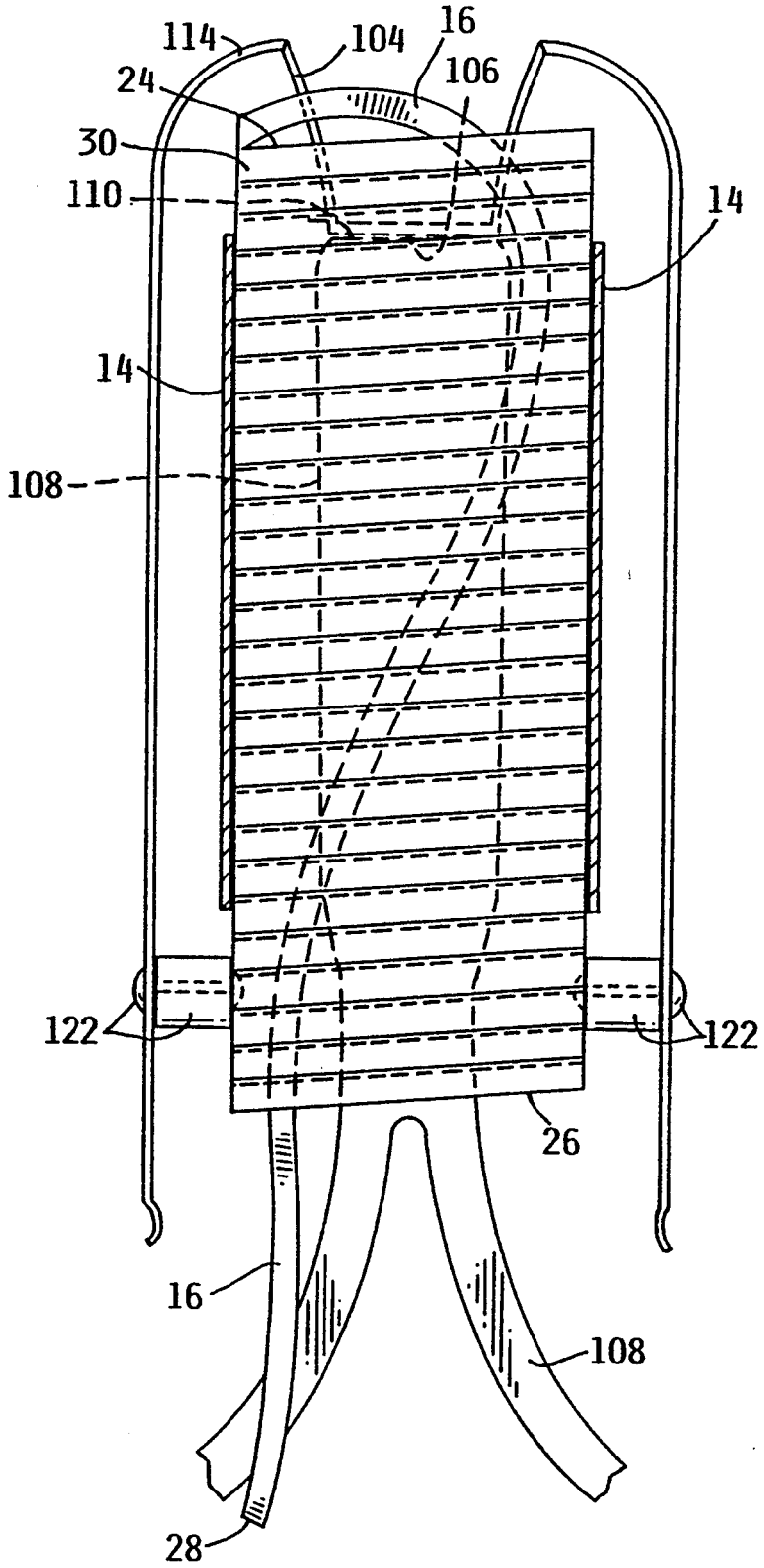
FIG. 4 is it side elevation view of the core and grip assembly of the type shown in FIG. 1 with a positioning member disposed at the distal end thereof to align the grip at a predetermined position on the handle segment of a racquet.
Figure 6:
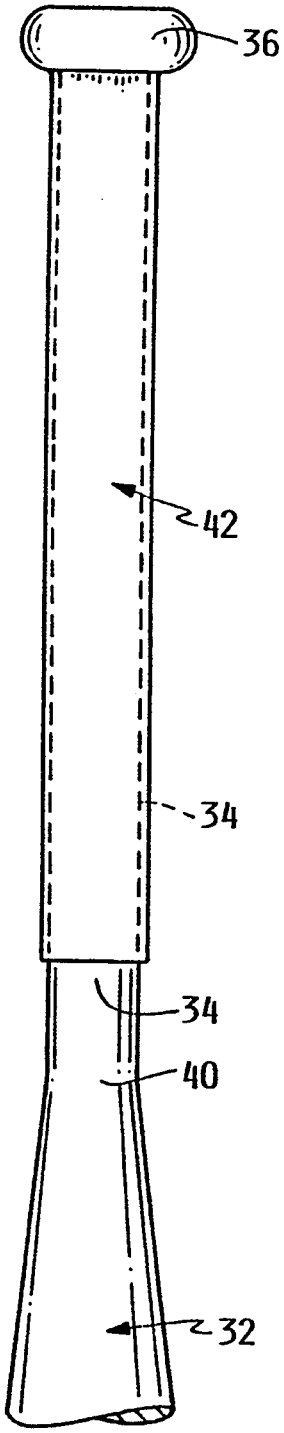
FIG. 6 is a side elevation view of the core and grip assembly of FIG. 1 showing the grip of FIG. 3 completely mounted on the handle segment.
Figure 9:
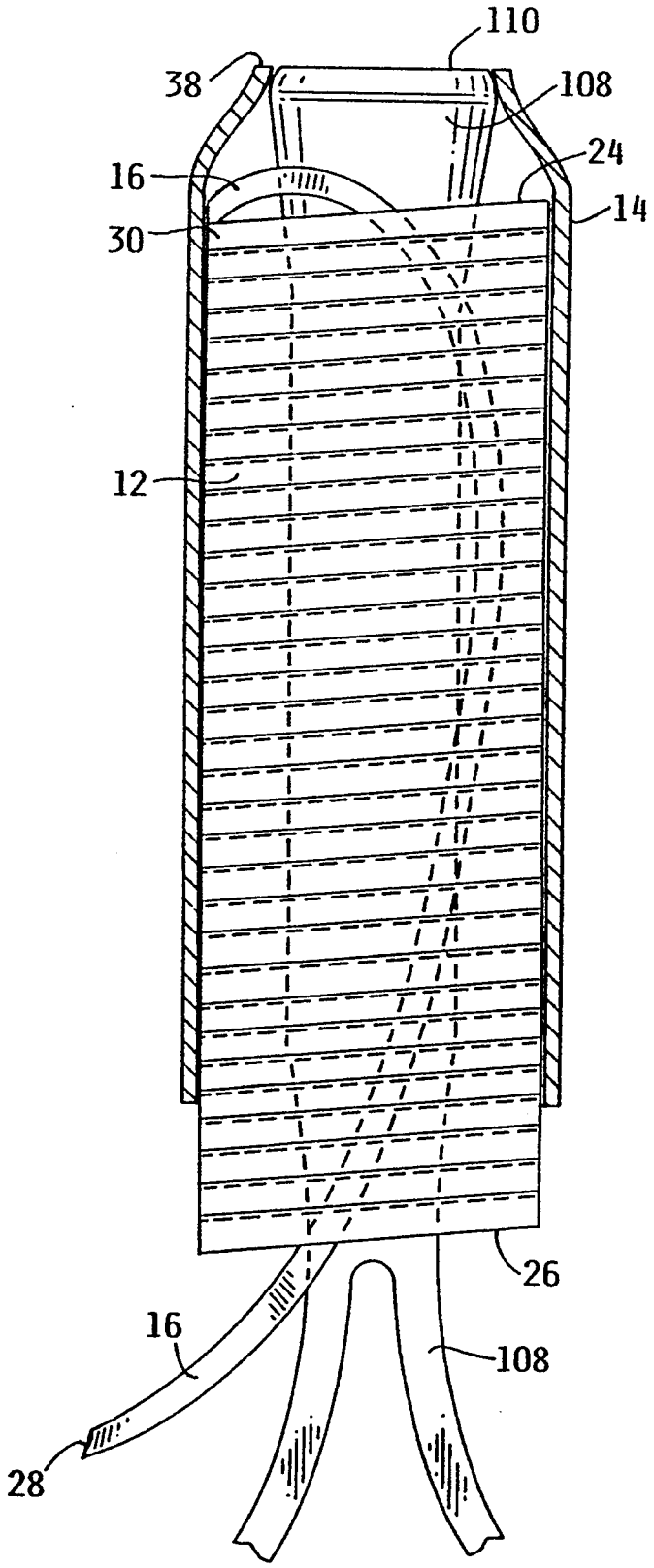
FIG. 9 is a partially broken away side elevation view of the core and grip assembly of FIG. 1 showing a sleeve member having a completely open distal end aligned with the terminal end of and partially ted on the handle of a racquet.

As shown in FIG. 4 with reference to a racquet 108, a similar positioning member 104 may be incorporated into the core and sleeve assembly 10 such that the exposed terminal end 110 of the handle segment 34 abuttingly contacts tile confronting surface 106 of the positioning member 104 to align the end of the sleeve member 14 at a predetermined position or reference point on the handle segment 34 of the racquet 108. The predetermined position for a racquet 108 will usually place the leading edge 38 of the sleeve member 14 very closely adjacent to or flush with the terminal end 110 of the racquet 108, just as though the user were installing a grip on a racquet 108 without using a positioning member 104 as shown in FIG. 9, thereby requiring that the contact surface 106 of the positioning member 104 be foreshortened or the relative axial distance from the contact surface 106 to the leading edge 38 of the sleeve member 14 be increased when compared to the core and sleeve assembly 10 as shown in FIG. 3 for mounting on an article having a knob-shaped end cap 36 such as a baseball bat 32.

With articles such as tennis or racquetball racquets, fishing rods, the predetermined reference point will generally be at or near the exposed terminal end 110 of the handle segment 34. With articles such as tools, equipment, or other implements including any variety of items such as hammers, wrenches, pliers, axes, picks, rakes, shovels, hoes, etc., the predetermined reference point will generally be at or within a preferred area anywhere along the handle segment 34, adjacent to or alternately displaced from the terminal end thereof.

Referring again to FIG. 3, one embodiment of the positioning member 104 is shown in which the positioning member 104 comprises a messed or indented section or portion of the external housing 114 or commercial display packaging for the core and sleeve assembly 10 contained therein. The housing 114 is preferably a transparent or translucent plastic material such as polystyrene which may be vacuum or blow molded as an integral or unitary piece with the positioning member 104. The housing 114 may be generally cylindrical in shape and preferably extends in circumferential relation substantially around the core and sleeve assembly 10, with the housing 114 being fixedly but removably connected to the sleeve member 14 or core 12 such that the surface 106 of the positioning member 104 remains in a designated or predetermined position and orientation relative to the leading edge 38 of the sleeve member 14. One method of fixing the positioning member 104 relative to the leading edge 38 of the sleeve member 14 is to adhere the depending peripheral edge 116 of the housing 114 to the outer surface 118 of the sleeve member 14 along one or more overlapping segments. This may be accomplished using an attachment piece 120 such as a polypropylene strap, adhesive tape, or other elastomeric or frictionally engaging band that may be applied to the outer surface of the housing 114 and sleeve member 14 and manually removed by peeling or cutting the attachment piece 120, or a releasable adhesive disposed between the inside surface of the depending peripheral edge 116 and the outer surface 118 of the sleeve member 14 that disengages either when the core 12 is removed and the sleeve member 14 contracts away from the housing 114 or when a removable tear-strip section (not shown) of the housing 114 is removed or disconnected from the remainder of the external housing 114 that carries the positioning member 104.

An alternate embodiment for affixing the positioning member 104 to the core and sleeve assembly 10 is shown in FIG. 4, in which the housing 114 or display packaging extends beyond the lower or trailing edge of the sleeve member 14 and is spaced apart from and connected to the core member 12 by one or more retaining members 122including fasteners which extend from the housing 114 to the core member 12 and intermediate portions disposed between the housing 114 and core 12 to maintain a separation between the housing 114 and core member 12. Other suitable connecting means such as an inwardly extending radial recess or groove extending around the housing 114, or a plurality of localized depressions or recesses which contact the core 12, and are adhered, sonically welded, or otherwise attached to the outer surface of the core member 12 may be utilized.

Figure 5:
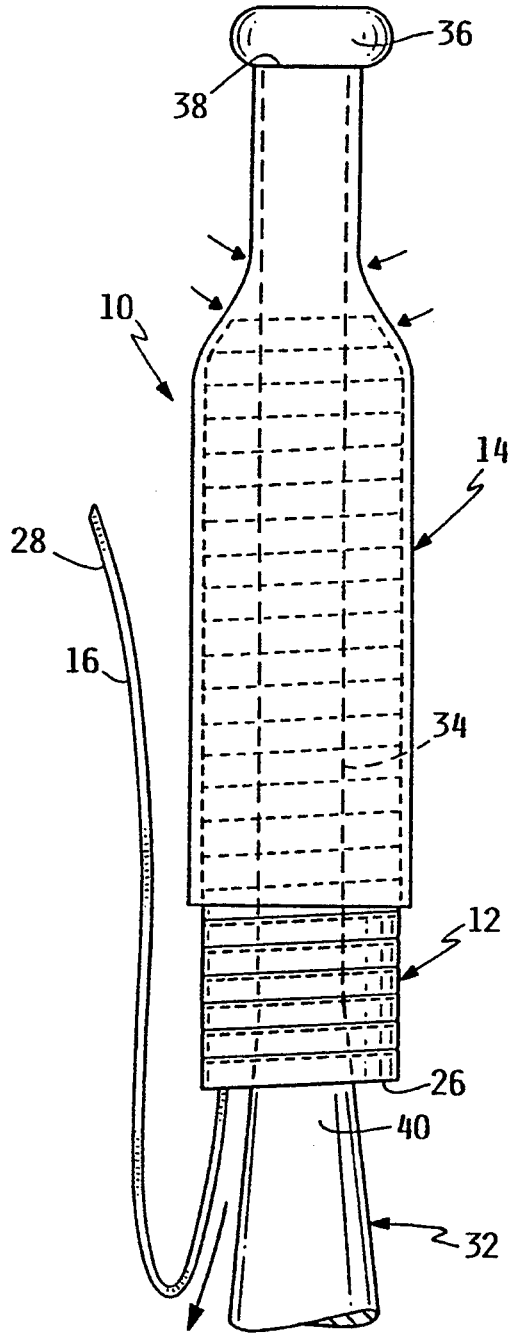
FIG. 5 is a side elevation view of the core and grip assembly of FIG. 1 showing the grip partially mounted on the handle segment.

Referring to FIG. 5, once the core and sleeve assembly 10 is positioned on the article such as a baseball bat 32 with the sleeve member 14 in the predetermined position, mounting is completed by the user grasping the proximal end 26 of the core member 12 and an adjacent exposed portion 40 of the underlying handle segment 34 within one hand, and grasping the free end 28 of the strip 16 with the other hand. The user will then apply gentle and consistent or increasing tension on the free end 28 of the strip 16, pulling the strip 16 through the hollow bore of the core member 12 and thereby causing the endmost coil or loop 30 of the core member 12 to peel away and separate from the remaining interconnected coils or loops of the core member 12. As continued tension is placed on the free end 28 of the strip 16, the spiral coils or loops of the core member 12 will sequentially separate from the remainder of the spiral core member 12 and unwind or collapse the mating segments of the core member 12, thus permitting the sleeve member 14 to contract radially toward and into direct frictional contact with the handle segment 34, moving progressively from the distal end 24 to the proximal end 26. Once the entire core member 12 has been unwound such that all the mating segments are separated and collapsed, the strip 16 will be free of the handle segment 34, and the sleeve member 14 will be fully contracted and mounted as a handgrip 42 on the handle segment 34 of the baseball bat 32 or other article as shown particularly in FIG. 6.

It may be appreciated that the sleeve member 14 will have a relaxed circumference and an expanded circumference, with the relaxed circumference being generally less than both the outer circumference of the outer surface of the handle segment 34 and the outer circumference of the core member 12. The terms diameter and circumference are used herein, however it is understood that the handle segment 34 of the article 32, the core member 12, and the sleeve member 14 need not have circular cross sections taken laterally at any or all longitudinal points, but may be a regular polygon (such as an octagonal tennis or racquetball racquet handle) or irregularly shaped.

The sleeve member 14 shown in FIGS. 1–6 is represented as having a generally smooth outer gripping surface, such as a smooth rubber handgrip 42 conventionally utilized on aluminum softball bats 32. However, it is understood that the outer gripping surface of the handgrip 42 may include, define, or incorporate any variety of compositions, surfaces, patterns, reliefs, or textures.

Figure 7:
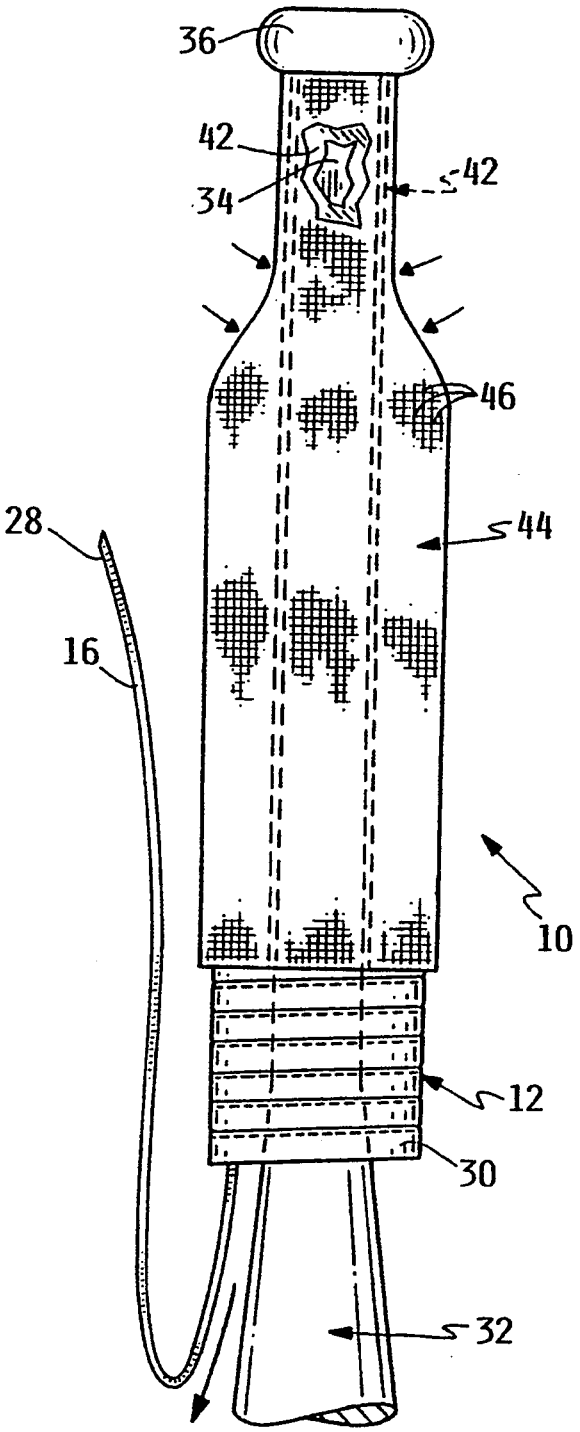
FIG. 7 is a side elevation view of a second core and grip assembly of the type shown in FIG. 1 showing a second serrated grip partially mounted in covering relation to the smooth grip of FIG. 6.

Referring particularly to FIG. 7, it may be seen that a second handgrip 44 having an outer gripping surface including rectangular serrations 46 or any other suitable textural pattern may be mounted on the handle segment 34 in overlaying relation to the first handgrip 42 using a like core and sleeve assembly 10 in the manner described above.

In constructing the spiral strip embodiment of the core and sleeve assembly 10, it has proven suitable to use an Elastic Cover and Removable Core Assembly of the type disclosed in U.S. Pat. No. 3,515,798 to Sievert for use in sealing splices in electrical cables, such an assembly currently marketed as a PST Cold Shrink Connector Insulator by the 3M Electrical Products Division of 3M Company in St. Paul, Minn.

As representative examples only, the physical dimensions and properties of two such 3M cold shrink connector insulators have proven suitable for applications of the type discussed herein relating to sporting goods. One example suitable for applying a handgrip 42 to a softball bat 32 as discussed above is the PST Cold Shrink Connector Insulator #8428-12, designated as being for 500–800 kcmil with an outside diameter range from 0.95"–1.90" and having a relaxed length of 12". This unit provides a spiral core member 12 having an hollow bore or inner diameter of 2.125" and an outer diameter of 2.250" with a length of 13", with the expanded sleeve member 14 being approximately 2.35" in outer diameter and having a length of approximately 9.3125" centered along the core member 12. The strip 16 is approximately 0.356" in width and 0.06" in thickness, and has an overall length of 23'–8" and 45° angled tapered ends. In the unstretched or fully contracted configuration, the sleeve member 14 has an outer diameter of approximately 1.10" and a thickness of 0.15", with a length of approximately 11.8125". As such, the sleeve member 14 has a greater length and thickness in the completely relaxed or contracted configuration than in the expanded or stretched configuration.

Another example suitable for applying a handgrip 42 to an thinner article such as a golf club, fishing rod, or hand tool having an outer diameter of no more than approximately 1.025" is the PST Cold Shrink Connector Insulator #8426-11, designated as being for 2/0-250 kcmil with an outside diameter ranging from 0.51"–1.00" and having a relaxed length of 11'. This unit provides a spiral core member 12 having an hollow bore or inner diameter of 1.070" and an outer diameter of 1.155" with a length of 11.625", with the expanded sleeve member 14 being approximately 1.25" in outer diameter and having a length of approximately 9.1875" centered along the core member 12. The strip 16 is approximately 0.24" in width and 0.04" in thickness, and has an overall length of 18' and 45° angled tapered ends. In the unstretched or fully contracted configuration, the sleeve member 14 has an outer diameter of approximately 0.70" and a thickness of 0.12", with a length of approximately 10.75".

The core member 12 may be fabricated from any suitable plastic material, such as white polyethylene, cellulose acetate butyrate, or a PVC polymer using a solid, corrugated, or laminated structure, although the core member 12 may be of any other suitable material such as cardboard or fiberboard. The sleeve member 14 may be fabricated from any suitable elastomeric material, such as EPDM rubber or a thermoplastic rubber or unsaturated elastomeric polymer such as Kraton® G. It is also understood that the sleeve member 14 may be fabricated to have a desired exterior shape or configuration within the tolerances and specifications required to permit the sleeve member 14 to be expanded and mounted on a suitable core member 12 and contract to a diameter sufficient to securely engage the outer surface of the handle segment 34.

Figure 8:
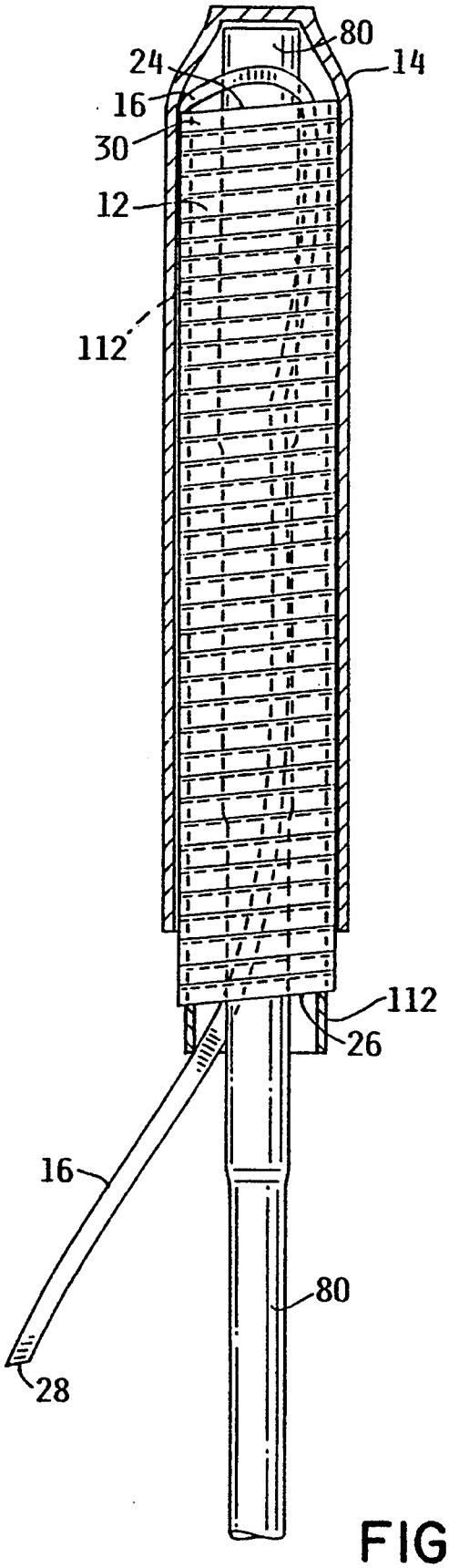
FIG. 8 is a partially broken away side elevation view of the core and grip assembly of the type shown in FIG. 1 on the shaft of a golf club, and further showing a sleeve member having a completely enclosed distal end and an inner support member disposed within the core.
Figure 10:
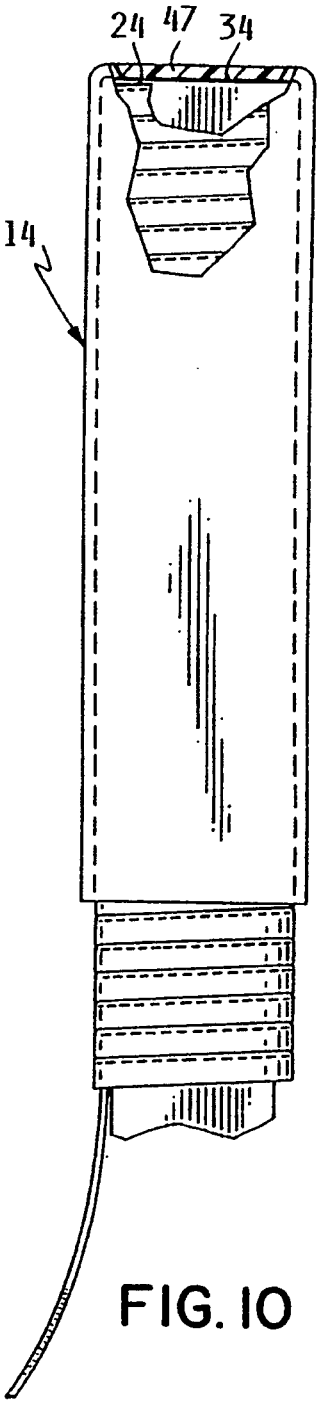
FIG. 10 is a partially broken away side elevation view of the core and grip assembly of the type shown in FIG. 1 showing a sleeve member having an enclosed distal end and a end support member therein.
Figure 12:
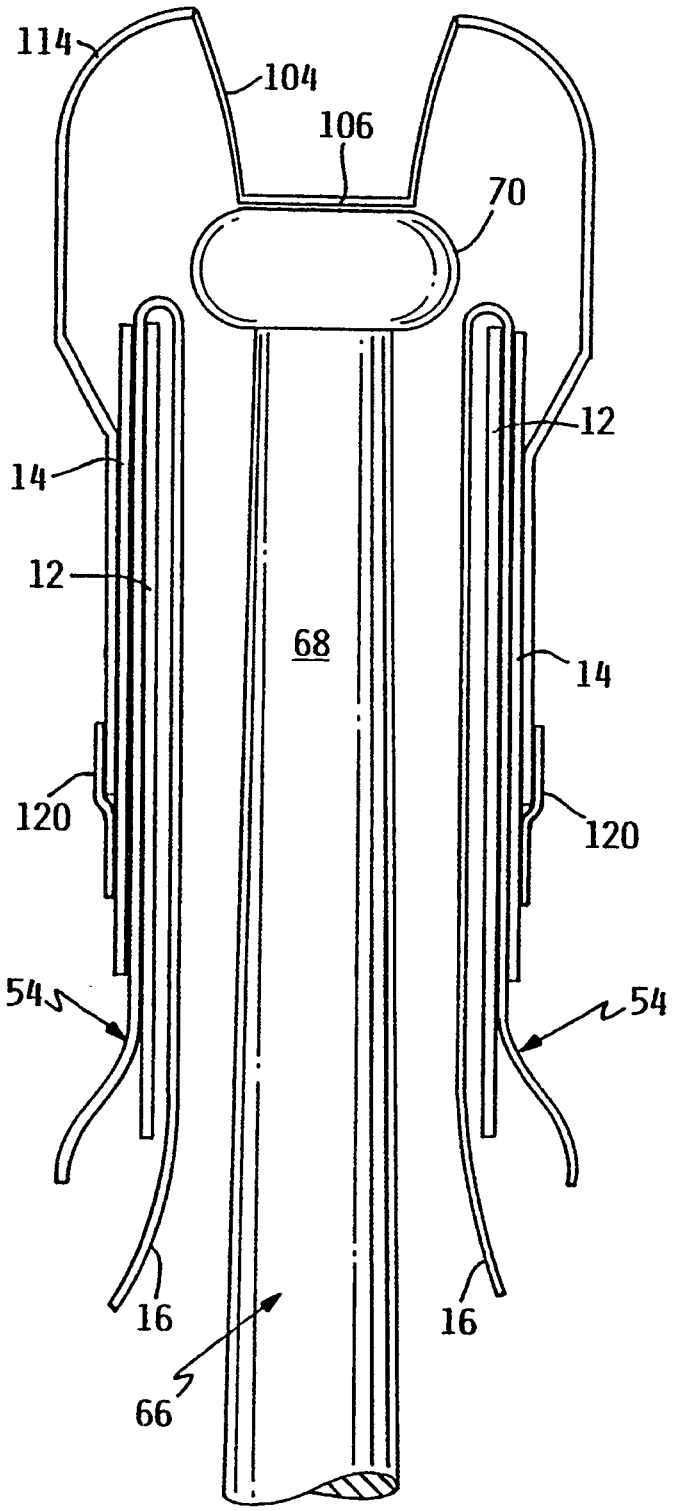
FIG. 12 is a partially broken away side elevation view of the core and strip embodiment of the type shown in FIG. 11 showing a positioning member disposed at the distal end thereof to align the grip at predetermined position on the handle segment of a baseball bat.
Figure 13:
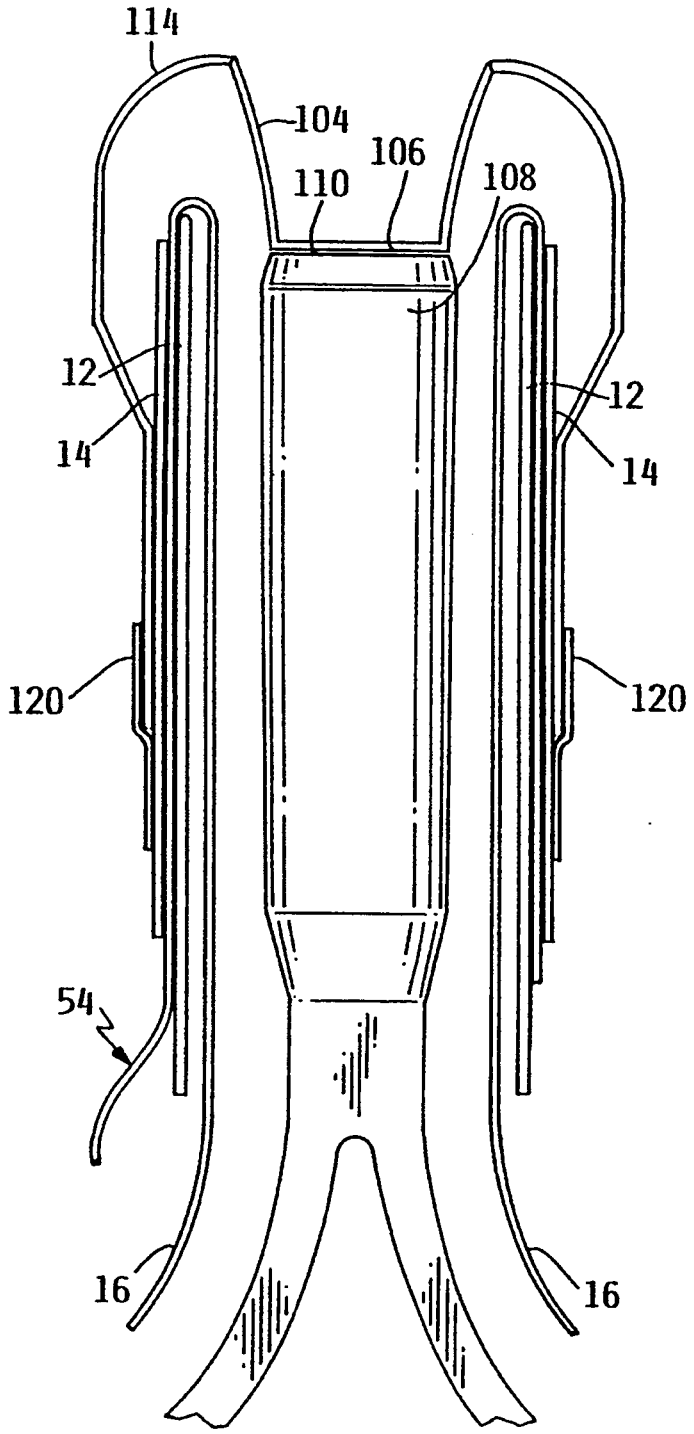
FIG. 13 is a partially broken away side elevation view of the core and strip embodiment of the type shown in FIG. 11 showing a positioning member disposed at the distal end thereof to align the grip at a predetermined position on the handle segment of a racquet.
Figure 14:
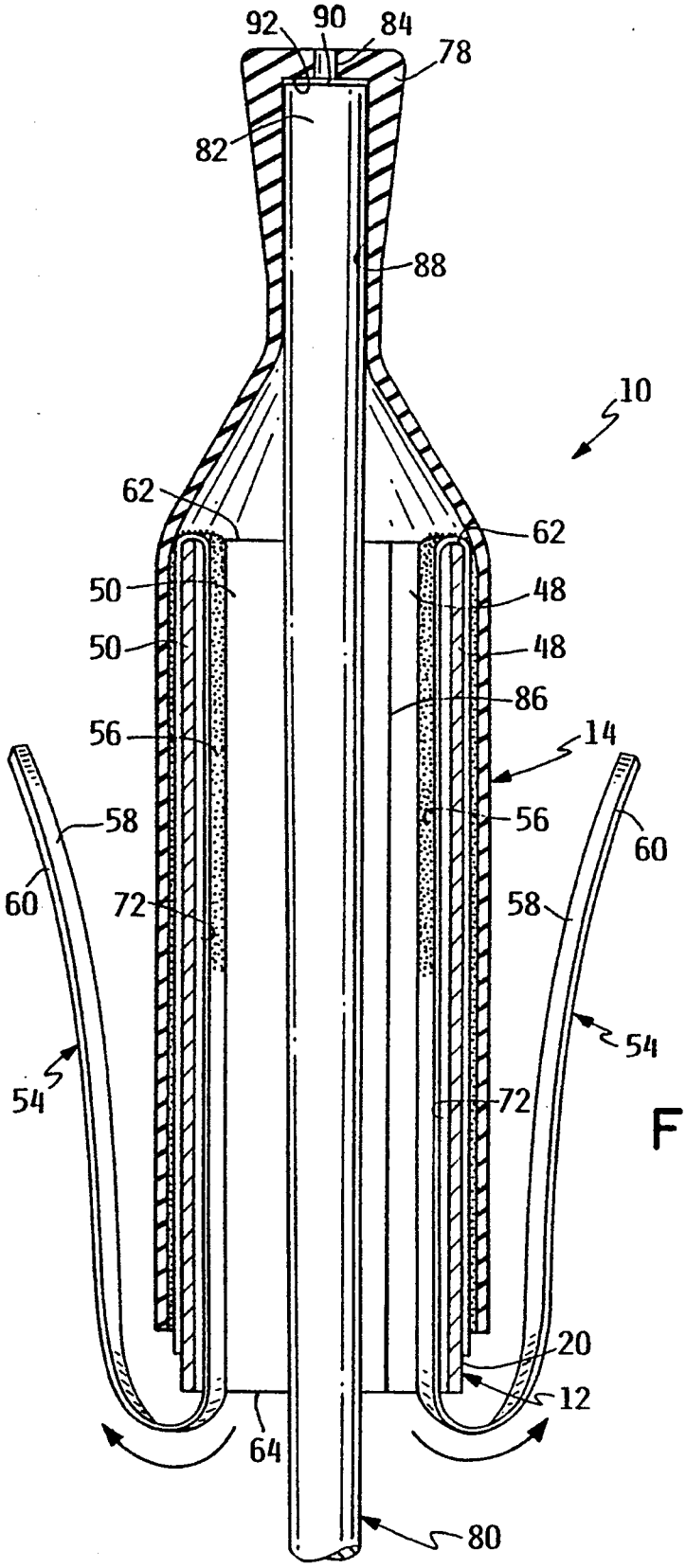
FIG. 14 is a .partially broken away side elevation view of an alternate version of the core and strip embodiment of this invention with the core having a single longitudinal seam and the sleeve having an enclosed distal end, and showing the grip partially mounted on the handle segment of a golf club.

The sleeve member 14 may be fabricated having two open ends as shown in FIGS. 1–7 and 9, or conversely may be fabricated having one open and one enclosed or partially enclosed end surrounding or partially surrounding the distal end 24 of the core member 12 as shown in FIGS. 8, 10, and 14, such that the exposed terminal end of the handle segment 34 of the article would be closely adjacent to or contact all or a portion of the enclosed or partially enclosed end of the sleeve member 14 when the handle segment 34 is completely received through the bore of the core member 12.

A representative example of an enclosed or partially enclosed grip is a golf club grip of the type currently marketed by companies such as Golf smith and Tacki-Mac®. These golf club grips do not have sufficient elastic modulus to exert the required radial pressure on the shaft of the golf club to securely engage the outer surface of the shaft after mounting. Such a grip may be utilized as a sleeve member 14 in the core and sleeve assembly 10, but may require additional setting time for the grip to contract fully and sufficiently into engaging contact with the outer surface of the shaft, or the application of double-faced adhesive tape to the outer surface of the shaft prior to mounting the grip thereon to adequately secure the grip to the shaft.

Referring particularly to FIGS. 8 and 10, it may be seen that in some applications the sleeve member 14 will preferably have a fully or a partially enclosed end which may be disposed at or near the exposed terminal end of the handle segment 34 when the sleeve member 14 is mounted on the handle segment 34. It may be readily appreciated that the inward radial pressure exerted by the sleeve member 14 on the distal end 24 of the core member 12 may cause the core member 12 to collapse prior to the sleeve member 14 being mounted on an article by the user.

As shown in FIG. 8, in some applications a single-pieced or multiple segmented inner support member 112 fabricated from plastic, hard rubber, cardboard, fiberboard, or another suitable material may be inserted within the bore of the core member 12 such that the inner support member 112 reinforces or supports the core member 12 against the radially inward force of the sleeve member 14 and prevents the premature collapse of the core member 12. The inner support member 112 is removed from within the bore of the core member 12 after the handle segment 34 is completely received within the corresponding bore of the inner support member 112 and before the sleeve member 14 is mounted onto the handle segment 34. The inner support member 112 should be slidably received within the bore of the core member 12 and held in place by frictional engagement or other suitable means such that only slight tension is required to remove the inner support member 112 from the core member 12, but such that the inner support member 112 will not accidentally or inadvertently become dislodged or be removed from the core member 12 prior to the core and sleeve assembly 10 being positioned or mounted on the article. The inner support member 112 may be a unitary piece that is manually cut off the article by the user or has a seam or tear line permitting separation and removal from the article, or multiple segments that mate or are joined along one or more seam or tear lines permitting disconnection or separation of the segments and removal from the article, or any other suitable fabrication.

In other applications such as shown in FIG. 10, an end support member 47 such as a plastic or hard rubber disk, toroid, or spoked ring may be inserted or fabricated integrally with the enclosed end of the sleeve member 14, with the end support member 47 remaining as a part of the handgrip mounted on the article, or may be selectively removed from the sleeve member 14 as or after the handgrip is mounted on the article, such as by pressure placed on the end support member 47 from within the sleeve member 14 by the terminal end 110 of the handle segment 34.

Core and Strip Embodiment

Referring particularly to FIGS. 11–16, various versions of a core and strip embodiment of the core and sleeve assembly 10 are shown.

Figure 11:
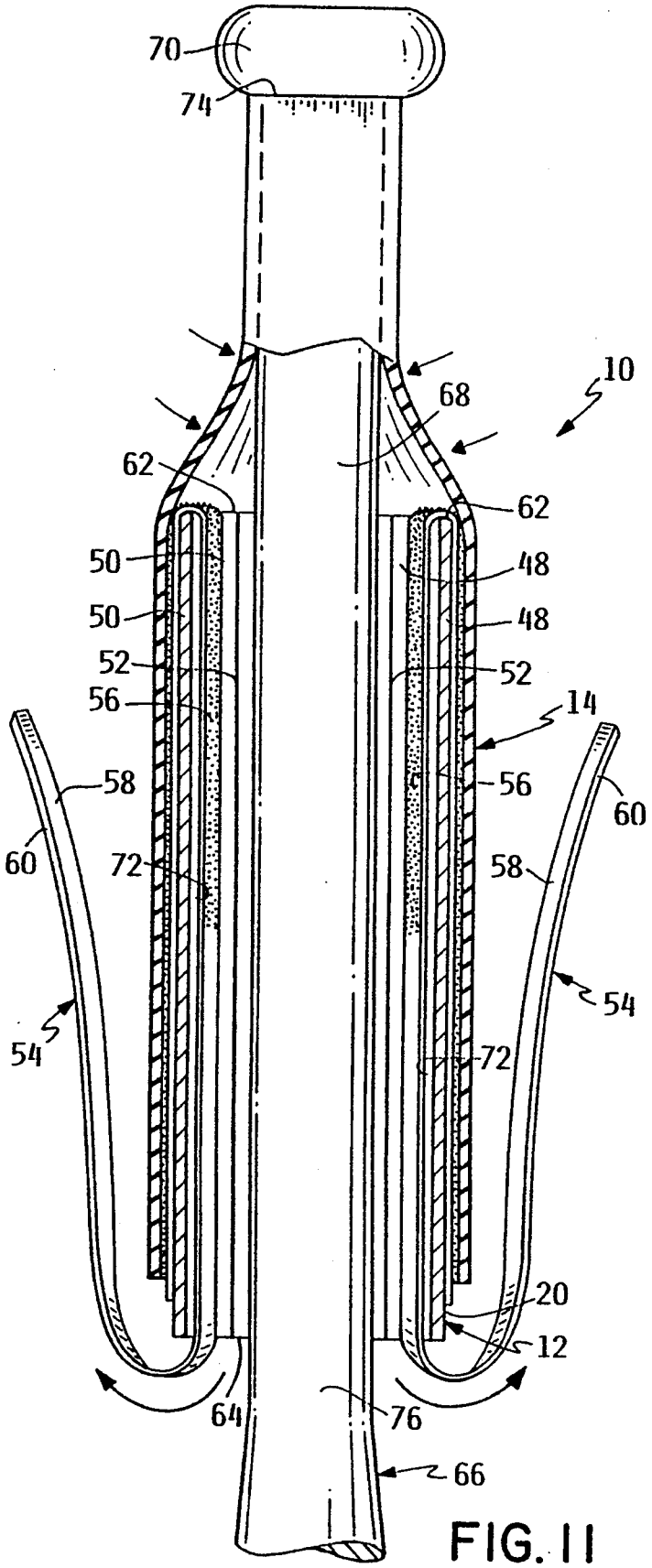
FIG. 11 is partially broken away side elevation view of one version of the core and strip embodiment of the core and grip assembly of this invention with the sleeve having two open ends and a plurality longitudinal seams, and showing the grip partially mounted on the handle segment of baseball bat.

Referring particularly to FIG. 11, a first version of the core and strip embodiment is shown in which the core member 12 is constructed from a plurality of generally longitudinally oriented segments 48, 50 which contact, hinge, or mate with one another along a plurality of generally longitudinal seam lines 52 to form a generally cylindrical core member 12 defining a hollow bore.

As in the spiral core embodiment, the elastomeric sleeve member 14 may be any suitable material such as rubber or plastic having a relaxed circumference and an expanded or stretched circumference, with the sleeve member 14 initially being stretched to the expanded circumference and mounted in circumscribing relation to the outer surface 20 of the core member 12 such that generally uniform radial pressure is exerted by the sleeve member 14 on the core member 12.

A plurality of flat strips or webs 54 are disposed between the outer surface 20 of the core member 12 and the inner surface of the sleeve member 14 and contact both. Each strip 54 is generally a very thin tape material having high tensile strength and minimal stretching characteristics, with one planar side 56 having a higher friction surface and the opposing planar side 58 having a lower friction surface.

Each strip 54 is disposed between and contacting the core member 12 and sleeve member 14 generally parallel with each of the longitudinal axes thereof, with the higher friction side 56 facing and contacting the inner surface of the sleeve member 14 and the lower friction side 58 facing and contacting the outer surface of the core member 12. Each strip 54 extends along the length of the portion of the core member 12 covered by the sleeve member 14, with the free ends 60 and remainder of the strips 54 being passed or folded over the distal end 62 of the core member 12, and extending through the hollow center bore of the core member 12 and a sufficient distance outwardly from and through the proximal end 64 of the core member 12.

As with the spiral core embodiment, an article such as a baseball bat 66 having a generally cylindrical handle segment 68 and a knob-shaped end cap 70 is aligned axially with the core and sleeve assembly 10 such that the knob-shaped end cap 70 or other exposed end of the article adjacent to the handle segment 68 is most closely proximate to the proximal end 64 of the core and sleeve assembly 10. The free ends 60 of the strips 54 are moved radially outward as close as practicable to the inner surface 72 of the core member 12, and the handle segment 68 of the bat 66 is slidably inserted longitudinally into and at least partially through the hollow bore of the core member 12 until the leading edge 74 of the sleeve member 14 is radially aligned with and overlapping the selectively predetermined position or reference point such as the joint between the cylindrical handle segment 68 and the knob-shaped end cap 70.

Referring particularly to FIGS. 12 and 13, it may again be seen that a positioning member 104 may be fixedly connected to the core and sleeve assembly 10 such that the knob-shaped end cap 70 of the baseball bat 66 abuttingly contacts a generally parallel, confronting surface 106 of the positioning member 104 to align the end of the sleeve member 14 at a predetermined position or reference point on the handle segment 68 of the baseball bat 66, or the exposed terminal end 110 of the handle segment 68 abuttingly contacts the confronting surface 106 of the positioning member 104 to align the end of the sleeve member 14 at a predetermined position or reference point on the handle segment 34 of the racquet 108.

Referring again to FIG. 11, once the core and sleeve assembly 10 has been positioned on the article such as a baseball bat 66, the user grasps the free ends 60 of one or more of the strips 54 with one hand or both hands, and may optionally grasp the proximal end 64 of the core member 12 and an adjacent exposed portion 76 of the underlying handle segment 68 within one hand. The user applies gentle and consistent or increasing tension on the free ends 60 of those strips 54 being gripped, pulling the strips 54 through the hollow bore of the core member 12. Friction between the inner surface of the sleeve member 14 and the higher friction sides 56 of the strips 54 holds the portions of the strips 54 between the sleeve member 14 and the core member 12 in a constant position relative to the sleeve member 14, however the tension on the free ends 60 of the strips 54 places pressure longitudinally on the distal end 62 of the core member 12, thus pushing or urging the core member 12 toward the proximal end 64 and out from within the sleeve member 14, thereby allowing the sleeve member 14 to collapse into direct contact with the handle segment 68 of the bat 66.

Once the core member 12 is completely removed from the sleeve member 14 and the sleeve member 14 is affixed as a handgrip to the handle segment 68 of the article 66, the mating longitudinal segments 48, 50 of the core member 12 may be completely separated or displaced from one another to remove the core member 12 from its surrounding or circumscribing relation to the handle segment 68.

In the core and strip embodiment of the core and sleeve assembly 10, it may be appreciated that the hollow bore of the core member 12 must have a sufficient diameter to permit that portion of the article adjacent to the proximal end 64 of the core member 12 and along a length generally equal to the length of the core member 12 to be received within the bore as the core member 12 is urged in the proximal direction by tension placed on the strips 54.

It is understood that in alternate embodiments the core member 12 may be an unitary or integral unit having a hollow bore with sufficient diameter to permit the core member 12 to be removed from within the sleeve member 14 and subsequently from the handle segment 68 of the article 66 by passing the core member 12 over the outside of the sleeve member 14 after the sleeve member 14 has been affixed to the handle segment 68 in the reverse direction, or the core member 12 may be cut, stripped, hinged, or disconnected along one line or in a plurality of locations for removal from the handle segment 68.

Depending upon such factors as the circumference of the core member 12, compression force of the sleeve member 14, and materials used to fabricate the core member 12, the separate longitudinal segments 48, 50 of the core member 12 may have jointed, hinged, or interlocking seam lines 52 to reinforce or maintain a generally cylindrical structure or other predetermined cross-sectional shape without the mating longitudinal segments 48, 50 slipping out of alignment with one another or collapsing prematurely due to the compression force of the sleeve member 14 and nonuniform or asymmetrical pressures exerted on the core and sleeve assembly 10 when it is handled or transported.

The core member 12 is preferably molded or fabricated using any suitable plastic material such as polyethylene or polystyrene, using a solid, corrugated, or laminated structure, although the core member 12 may be of any other operable material such as cardboard or fiberboard.

The strips 54 may be fabricated from any variety of materials, including an adhesive backed tape having fiberglass filaments imbedded therein to provide high tensile strength and resistance to stretching or distortion, or alternately a low friction Tyvek or Kevlar strip 54 optionally having one surface roughened or treated with a friction-increasing coating such as a permanent matte acrylic spray or a releasable artist spray mount adhesive. In applications where the higher friction side 56 of the strips 54 have an adhesive nature or character, only the portion of the higher friction side 56 of the strips 54 actually disposed between and contacting the inner surface of the sleeve member 14 needs to be coated or otherwise treated to develop positive adhesion.

Referring particularly to FIG. 14, an alternate version of the core and strip embodiment is shown in which the sleeve member 14 includes an enclosed end section 78 having a non-uniform vertical cross-section. In FIG. 14, the sleeve member is shown being mounted on an article such as a golf club shaft 80 having a tubular or rod-shaped handle segment 82 with a generally smooth outer surface and a gradual radial taper directed away from the terminal end thereof. In applications such as handgrips for golf club shafts 80 and similar articles, it is a common practice to form an aperture 84 along and aligned with the longitudinal axis of the handle segment 82 and extending completely through the enclosed end section 78 of the sleeve member 14.

The core member 12 as shown in FIG. 14 is of a one-piece construction having a single generally longitudinal seam line 86 extending the length of the core member 12. It may be appreciated that a single-piece core member 12 of this type would be preferable where the handle segment 82 of the article has an extended length and smaller diameter than an article such as a baseball or softball bat 66 such that the core member 12 may be completely removed from the sleeve member 14 before the core member 12 is removed from the handle segment 82. The core member 12 can be removed from the narrow handle segment 82 by pulling or prying the core member 12 open along the longitudinal seam line 86, twisting the core member 12 from the handle segment 82, or forcibly pulling the core member 12 radially away from and off the handle segment 82 allowing the handle segment 82 to slide between the edges of the longitudinal seam line 86. The single-piece core member 12 may also be used with an article such as a baseball or softball bat 66 having a barrel (not shown) greater in diameter than the handle segment 68 or the core member 12, however the core member 12 should be fabricated from a material that is sufficiently flexible or pliable to permit the core member 12 to slide over the barrel and open the longitudinal seam member 86 without requiring undue additional exertion or force by the user.

It may be appreciated that the longitudinal seam lines 52, 86 in either the multiple- or single-piece core member 12 need not be straight or oriented parallel with the longitudinal axis of the core member 12, but may alternately be twisted or spiral a predetermined amount around the periphery of the core member 12. As with the spiral core embodiment, the longitudinal seam lines 52, 86 need not extend completely through the core member 12, but may permit the segments 48, 50 of the core member 12 to remain partially connected to one another, or may utilize a pull strip or score line along which the longitudinal seam lines 52, 86 and segments 48, 50 must be physically separated.

For purposes of clarity when discussing the single- and multiple-piece core members 12, reference has been made to a plurality of segments 48, 50 in connection with the multiple-piece core member 12. It is understood that in the single-piece core having a single longitudinal seam the portions of the core member 12 disposed on opposing sides of the longitudinal seam line 86 may be considered as separate segments 48, 50 which are pivotally or hingedly connected along an indiscriminate or undifferentiated portion of the core member 12 opposing or displaced from the longitudinal seam line 86, with those segments 48, 50 mating along the longitudinal seam line 86.

In the version of the core and strip embodiment shown in FIG. 14, it may be appreciated that the enclosed end 78 of the sleeve member 14 may be formed with a thicker cross-section or incorporating a less elastic material which diminishes or precludes the ability to expand the enclosed end 78 of the sleeve member 14 to the outer diameter of the core member 12. In such applications, it is anticipated that the inner bore 88 of the enclosed end 78 of the sleeve member 14 will have a diameter approximately equal to or slightly less than the outer diameter of the handle segment 82 so that the handle segment 82-may be slidable inserted and frictionally engage the inner surface of the sleeve member 14 with the terminal end 90 of the handle segment 82 contacting or closely confronting the inner end 92 of the sleeve member 14. The distal end 62 of the core member 12 will therefore initially be displaced a predetermined distance from the inner end 92 of the sleeve member 14, as shown for exemplary purposes in FIG. 14 and in FIG. 8 with reference to the core and strip embodiment.

Figure 15:
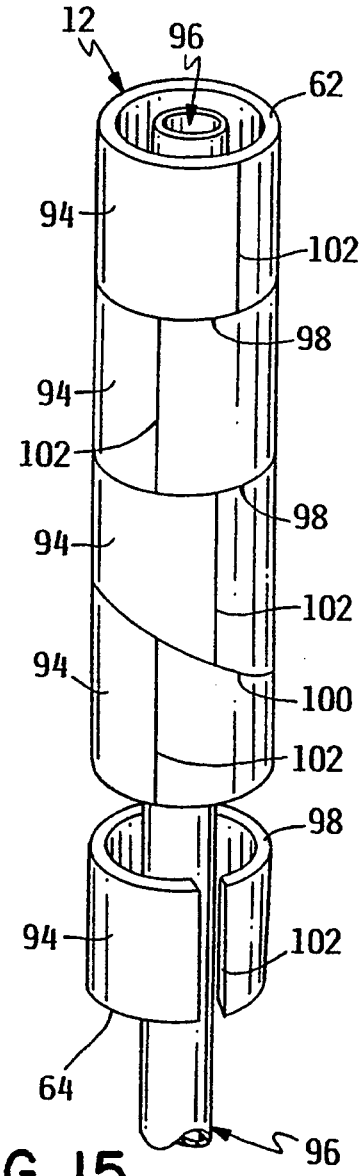
FIG. 15 is a partially exploded perspective view of an alternate version of the core member of the core and strip embodiment of this invention, wherein the core member includes several ring segments having both longitudinal and transverse seam lines, and showing the core member disposed surrounding a rod-like article such as a golf club shaft.
Figure 16:
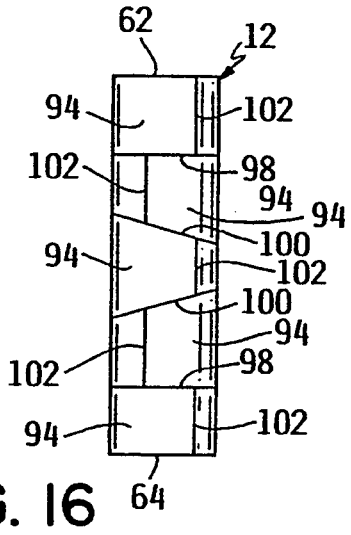
FIG. 16 is a diagrammatic side elevation view of the core member of the type shown in FIG. 15 showing transverse seam lines which are both perpendicular and non-perpendicular to the longitudinal axis of the core member.

Referring to FIGS. 15 and 16, an alternate version of the core and strip embodiment is shown in which the core member 12 is composed of several tall-toroidal or ting segments 94, with the core member 12 shown without the corresponding sleeve member 14 and positioned surrounding or circumscribing a generally rod shaped article 96.

Each ring segment 94 adjoins at least one adjacent ring segment 94 along or across a transverse seam line 98, 100 or separation line, and each ring segment 94 further defines at least one generally longitudinal seam line 102. While the use of two or more contacting ring segments 94 provides certain advantages for manufacturing the core member 12, the ring segments 94 may be spaced apart from one another beneath the sleeve member 14 in some applications to achieve advantages such as reduced material consumption.

It may be readily appreciated that the longitudinal seam line 102 of adjoining ring segments 94 need not be (and in some applications preferably are not) aligned axially with one another as shown in FIGS. 15 and 16. It may further be appreciated that the transverse seam lines 98, 100 need not be oriented at an angle generally perpendicular to the longitudinal axis of the core member 12, and that by orienting the transverse seam lines 100 of closely adjacent or contacting ring segments 94 at an angle other than perpendicular relative to the longitudinal axis of the core member 12, the axial displacement between two adjoining longitudinal seam lines 102 will be maintained at a predetermined interval when the core member 12 is covered by the sleeve member 14 and the ring segments 94 are prevented from moving longitudinally apart from one another.

When the sleeve member 14 is mounted on the article 96 by removing the core member 12 from the proximal end of the sleeve member 14, each of the ring segments 94 will be removed from the sleeve member 14 sequentially starting with the ting segment 94 located nearest the proximal end 64 and proceeding toward the ring segment 94 located nearest the distal end 62. The ring segments 94 may then be removed from the article 96, or alternately, the ring segments 94 may each be removed from the article 96 as each ting segment 94 is dislocated from the remaining ring segments 94 and the sleeve member 14. It may be appreciated that multiple ring segments 94 will in some cases permit the use of a less flexible or less pliable material for the core member 12 than would be suitable for a single-piece core member 12 with a single longitudinal seam line 102 having a length equal to the combined lengths of the several ring segments 94, since the force required to bend the ring segments 94 or separate the longitudinal seam lines 102 should be less than for an equivalent single-piece core member 12 having a single longitudinal seam line 102.

While the free ends 28, 60 of the strips 16, 54 in each embodiment are preferably gripped manually by the hand of the user for most applications, it is also anticipated that in other applications it may be suitable or preferred to grip the free ends 28, 60 of the strips 16, 54 using a tool such as a pair of pliers, or a specially designed tool having a handle that engages an aperture or fastener on the free ends 28, 60 of the strips 16, 54.

The applicability of the core and sleeve assembly 10 of this invention to mounting handgrips or any elastomeric covering material to an article may include, but is certainly not limited to, various articles such as: sporting goods including a baseball or softball bat, tennis, squash, badminton, or racquetball racquet, ping-pong paddle, golf club, hockey, field hockey, or lacrosse stick, bicycle handlebar, weight lifting bar, exercise equipment handles, archery bow, fishing rod or net; implements such as gardening tools including a rake, hoe, or shovel; and tools or equipment such as a hammer, Sven® or bow-type saw, wrench, pair of pliers, crowbar, cat's paw, or pry bar.

It is understood that in some applications the core and sleeve assembly 10 may be placed on the article using the distal end 24, 62 as the leading end rather than the trailing end, although the core member 12 will preferably but not necessarily continue to be removed from within the sleeve member 14 starting at the distal end 24, 62 and progressing toward the proximal end 26, 64.

While the preferred embodiments of the above core and sleeve assembly 10 have been described in detail with reference to the attached drawing Figures, it is understood that various changes and adaptations may be made in the core and sleeve assembly 10, or the manner in which such an apparatus is utilized to practice the process of mounting a handgrip on an article as disclosed herein, without departing from the spirit and scope of the appended claims.

What is claimed is:

1. An assembly for mounting a handgrip on a handle segment of an article of sporting goods in a predetermined position by a user, said handgrip being mounted on said handle segment such that a first reference point on said handgrip is generally aligned with a second reference point on said handle segment when said handgrip is in said predetermined position, said assembly comprising:

a core member, said core member having a plurality of segments, said plurality of segments mating with one another to define an outer surface having an outer circumference, an inner surface, and a bore extending through said core member, said core member having a distal end and a proximal end and a portion that may be manually gripped by the user; and a sleeve member, said sleeve defining the handgrip and having a gripping surface exposed to the user which may be gripped by the user during use of the article to prevent the article from slipping from the grip of the user, said sleeve member being fabricated from a generally elastomeric material and having a generally tubular shape, said sleeve member having a relaxed circumference and an expanded circumference, said relaxed circumference being generally less than said outer circumference of said outer surface of said core member, said sleeve member initially being expanded and disposed in circumscribing relation on said core member in generally a same configuration as the handgrip is to be mounted on the handle segment of the article, said core member or said sleeve member or both including an alignment aid for verifying that the first reference point on the handgrip is generally aligned with the second reference point on the handle segment when the handgrip is in the predetermined position, whereby the handle segment of the article is received at least partially within the bore of the core member from the proximal end thereof such that at least a portion of the sleeve member is adjacent to the predetermined position, and the user grips the portion of the core member and manually applies tension to the portion to remove the core member from within the sleeve member such that the sleeve member contracts progressively into contact with the handle segment of the article from the distal end toward the proximal end, thereby disposing the gripping surface exposed to the user such that it is gripped by the user during use of the article to prevent the article from slipping from the grip of the user.

2. The assembly of claim 1 wherein the plurality of segments of the core member mate with one another along a plurality of generally transverse seams.

3. The assembly of claim 1 wherein the core member is a single strip of generally flat material wound into a generally spiral helix defining a generally hollow cylindrical shape.

4. The assembly of claim 1 wherein the core member is a strip wound into a spiral having a series of abutting loops, each of said series of abutting loops being generally circular, said series of abutting loops forming the inner surface and the outer surface.

5. The assembly of claim 4 wherein each of the series of abutting loops is connected to at least an adjacent one of the series of abutting loops along a separable tear line, said separable tear line permitting the series of abutting loops to be separated from one another when the user applies the tension on the core member.

6. The assembly of claim 4 wherein the strip defines a free end extending from and connected to the distal end of the core member, said free end extending through the bore of the core member and projecting from the proximal end thereof such that said free end is the portion of the core member gripped by the user.

7. The assembly of claim 4 wherein the user grips the free end of the strip and applies the tension thereto in order to unwind the spiral and separate the series of abutting loops progressively from the distal end to the proximal end of the core member.

8. The assembly of claim 1 wherein the inner surface of the core member is generally cylindrical, and wherein the outer surface of the core member is generally cylindrical.

9. The assembly of claim 1 wherein the plurality of segments of the core member mate with one another along a plurality of generally longitudinal seams.

10. The assembly of claim 1 wherein the plurality of segments of the core member mate with one another along a single generally longitudinal seam.

11. The assembly of claim 9 wherein the core member has a generally hollow cylindrical shape.

12. The assembly of claim 9 wherein the core member further comprises:

at least one strip, said at least one strip having a lower friction side and a higher friction side, said at least one strip being disposed between the sleeve member and the core member with said lower friction side contacting the core member and said higher friction side contacting the sleeve member, said at least one strip having a free end, said free end being folded over the distal end of the core member and extending through the bore of the core member and projecting from the proximal end thereof such that said free end is the portion gripped by the user.

13. The assembly of claim 12 wherein the user grips the free end of the at least one strip and applies the tension thereto in the direction of the proximal end in order to slidably withdraw the plurality of segments of the core member from within the sleeve member.

14. The assembly of claim 1 wherein the article is a bat defining a generally knob-shaped projection disposed adjacent to the handle segment, said knob-shaped projection having a diameter, and wherein the bore of the core member has a diameter greater than the diameter of said knob-shaped projection, such that said knob-shaped projection may be at least partially received within the bore of the core member.

15. The assembly of claim 14 wherein the knob-shaped projection is received entirely through the bore of the core member.

16. The assembly of claim 1 wherein the sleeve member at least partially encloses the distal end of the core member.

17. The assembly of claim 16 wherein the sleeve member completely encloses the distal end of the core member.

18. An assembly for mounting a handgrip on a handle segment of an article of sporting goods in a predetermined position by a user, said handgrip being mounted on said handle segment such that a first reference point on said handgrip is generally aligned with a second reference point on said handle segment when said handgrip is in said predetermined position, said assembly comprising:

a core member, said core member having an outer surface having an outer circumference and a generally hollow bore extending through said core member, said core member having a distal end and a proximal end and a portion that may be manually gripped by the user; and a sleeve member, said sleeve member being fabricated from a generally elastomeric material and having a generally tubular shape, said sleeve member having a relaxed circumference and an expanded circumference, said relaxed circumference being generally less than said outer circumference of said outer surface of said core member, said sleeve member initially being expanded and disposed in circumscribing relation on said core member in generally a same configuration as the handgrip is mounted on the handle segment of the article, said core member or said sleeve member or both including an alignment aid for verifying that the first reference point on the handgrip is generally aligned with the second reference point on the handle segment when the handgrip is in the predetermined position, whereby the handle segment of the article is received at least partially within the generally hollow bore of the core member from the proximal end thereof, the portion of the core member being gripped adjacent to the proximal end thereof by the user with tension applied manually by the user to the portion of the core member to remove the core member from within the sleeve member such that the sleeve member contracts progressively into contact with the handle segment of the article from the distal end to the proximal end.

19. The assembly of claim 18 wherein the alignment aid further comprises:

a positioning member, said positioning member being connected to the sleeve member such that said positioning member is maintained in a fixed position relative to the sleeve member when the sleeve member is disposed in circumscribing relation on the core member prior to mounting the handgrip on the handle segment of the article, said positioning member defining a surface which contacts a specified portion of the article when the handle segment of the article is received within the generally hollow bore of the core member and the sleeve member is in the predetermined position relative to the handle segment of the article, whereby the user positions and aligns the sleeve member of the assembly at the predetermined position on the handle segment of the article by receiving the handle segment of the article within the generally hollow bore of the core member until the surface of the positioning member contacts the specified portion of the article, and may maintain such contact as the mounting of the handgrip on the handle segment of the article is started to ensure that the handgrip is mounted at the predetermined position on the handle segment of the article.

20. The assembly of claim 19 wherein the assembly further comprises:

an external housing, said external housing being disposed surrounding at least a portion of the core member and the sleeve member, said external housing defining the positioning member.

21. The assembly of claim 19 wherein the housing comprises the commercial display packaging for the assembly.

22. The assembly of claim 19 wherein the positioning member is releasably attached directly to a portion of the sleeve member.

23. The assembly of claim 19 wherein the positioning member is attached directly to a portion of the core member.

24. An assembly for mounting an elastomeric covering material in a predetermined position on an article of sporting goods by a user, said handgrip being mounted on said handle segment such that a first reference point on said handgrip is generally aligned with a second reference point on said handle segment when said handgrip is in said predetermined position, said assembly comprising:

a core member, said core member having at least one segment, said at least one segment defining an outer surface having an outer circumference, an inner surface, and a bore extending through said core member, said core member having a distal end and a proximal end and a portion that may be manually gripped by the user; and a sleeve member, said sleeve member being fabricated from a generally elastomeric material and having a generally tubular shape, said sleeve member having a relaxed circumference and an expanded circumference, said relaxed circumference being generally less than said outer circumference of said outer surface of said core member, said sleeve member initially being expanded and disposed in circumscribing relation on said core member in generally a same configuration as the handgrip is mounted on the handle segment, said core member or said sleeve member or both including an alignment aid for verifying that the first reference point on the handgrip is generally aligned with the second reference point on the handle segment when the handgrip is in the predetermined position, whereby the handle segment of the article is received at least partially within the bore of the core member from the proximal end thereof, at least a portion of the core member being gripped adjacent to the proximal end thereof by the user with tension applied manually by the user to said portion of the core member to remove the core member from within the sleeve member such that the sleeve member contracts progressively into contact with the handle segment of the article from the distal end toward the proximal end.

25. The assembly of claim 24 wherein the at least one segment of the core member further comprises:

a plurality of ring segments, each of said plurality of ring segments adjoining at least one of said plurality of ring segments along at least one generally transverse seam line.

26. The assembly of claim 25 wherein the bore of the core member has a generally longitudinal axis, and wherein at least one of the at least one generally transverse seam line is oriented at an angle that is generally perpendicular to said generally longitudinal axis.

27. The assembly of claim 25 wherein the bore of the core member has a generally longitudinal axis, and wherein at least one of the at least one generally transverse seam line is oriented at an angle that is not generally perpendicular to said generally longitudinal axis.

28. The assembly of claim 24 wherein the article is selected from the group consisting of: a baseball bat, a softball bat, a tennis racquet, a racquetball racquet, a squash racquet, a badminton racquet, a ping-pong paddle, a golf club, a hockey stick, a field hockey stick, a lacrosse stick, a bicycle handlebar, a handle for exercise equipment, a weight lifting bar, an archery bow, a fishing rod, or a fishing net.

* * * * *